US005938628A

United States Patent [19]

Oguri et al.

[11] Patent Number: 5,938,628

[45] Date of Patent: Aug. 17, 1999

[54] SUIT-TYPE COSMETIC AIR MASSAGE DEVICE

[75] Inventors: Shinichi Oguri; Masaru Yoshida; Masaki Wada, all of Osaka, Japan

[73] Assignee: Kabushiki Kaisha Fuji Iryoki, Osaka, Japan

[21] Appl. No.: 08/867,919

[22] Filed: Jun. 3, 1997

[51] Int. Cl.[6] ..... A61H 9/00

[52] U.S. Cl. ..... 601/150; 601/152

[58] Field of Search ..... 601/149–52; 606/202; 602/13

[56] References Cited

U.S. PATENT DOCUMENTS

| | | | |
|---|---|---|---|
| 1,608,239 | 11/1926 | Rosett | 601/152 |
| 2,345,073 | 3/1944 | Rosett | 601/149 X |
| 2,361,242 | 10/1944 | Rosett | 601/152 |
| 3,288,132 | 11/1966 | Meredith | 128/24 |
| 4,353,359 | 10/1982 | Milbauer | 128/66 |
| 4,355,632 | 10/1982 | Sandman | 601/152 |
| 5,022,387 | 6/1991 | Hasty | 128/64 |
| 5,478,119 | 12/1995 | Dye | 285/26 |
| 5,611,772 | 3/1997 | Fujimoto et al. | 601/150 X |

FOREIGN PATENT DOCUMENTS

| | | | |
|---|---|---|---|
| 498943 | 1/1976 | U.S.S.R. | 601/152 |
| 1452523 | 1/1989 | U.S.S.R. | 601/152 |
| 90/06740 | 6/1990 | WIPO | 601/151 |

*Primary Examiner*—Danton D. DeMille
*Attorney, Agent, or Firm*—Flynn, Thiel, Boutell & Tanis, P.C.

[57] ABSTRACT

A suit-type cosmetic air massage device for providing air pressuring massage upon a human whole body. To provide air pressuring massage, suit-shaped parts are made to cover a human whole body, and can be separated into an upper suit-shaped part and a lower suit-shaped part. And plural air bags are symmetrically installed within the left and right side from the position corresponding to the hand region to the position corresponding to the shoulder regions of the upper suit-shaped part, and from the position corresponding to the feet parts to the waist part of the lower suit-shaped part. These air bags are divided into the first, second, third and fourth group, and each air bag in each group can be supplied with air simultaneously or independently in order from connecting with the intake/exhaust instrument by an intaking/exhausting hose.

12 Claims, 7 Drawing Sheets

SUIT-TYPE COSMETIC AIR MASSAGE DEVICE

BACKGROUND OF THE INVENTION

1. Field of the Invention

This invention relates to an air massage device where plural air bags installed within can be inflated/deflated by compressed air. Especially, a suit-type cosmetic air massage device being quilted for making to a suit-shaped parts where plural air bags installed within, such as arm or leg regions can be inflated/deflated by compressed air to provide air pressuring massage to a user.

2. Description of the Prior Art

Previously invented air massage devices, such as a mat-type air massage device, are constructed so that plural air bags installed within the body of the mat can be inflated/deflated by compressed air to provide with air massage upon the backside of human body, and a chair-type air massage device is constructed so that plural air bags installed within the backrest can be inflated/deflated by compressed air and can provide an air massage upon the back part of a human body.

And now, a pocket-type air massage device for providing air pressuring massage to an appropriate part of human body, such as an arm or a leg by a pocket where plural air bags installed within can be inflated/deflated by compressed air, is being developed. And this air pressuring massage can not be provided by the above mat-type air massage device or chair-type air massage device.

However, to inflate/deflate plural air bags with air in order, it is usually that a rotary valves are equipped into an intake/exhaust instrument of the above-mentioned device for changing the intaking/exhausting of compressed air.

Therefore, in the conventional air massage devices as above-mentioned, the plural air bags can repeat to pressurize/release upon the contacting parts of human body by inflating/deflating in order. And the stimulation occurred by air is comparatively soft so that old people whose bones are getting weaker, desire it very much because they may avoid damaging their bones.

But, it had very troublesome problem to use the conventional air massage devices as the above-mentioned, as the pressurizing/releasing of compressed air is repeated upon only one part of human body, and can not provide massage upon the whole body, the massage ranges are limited to one part or back part of human body, and the massage is liable to be monotonous too. And the whole body can not be provided with a balanced massage.

SUMMARY OF THE INVENTION

This invention improves upon the above-mentioned problems, providing a suit-type cosmetic air massage device which can provide air driven pressure massage upon almost the whole body of a user.

And providing a suit-type cosmetic air massage device which can provide different pressuring massage upon a human body in order. A user can select a desired massage type by a control measure because the control measure can operate massaging ways equipped for providing regular or non-regular air pressuring massage in order to massage the whole body of a human. And this air pressuring massage can not provided by any of above prior devices.

In order to achieve the above purpose, the suit-shaped parts of the suit-type cosmetic air massage device are installed within plural air bags which are connected with an intake/exhaust instrument via each intaking/exhausting hose.

Further, in the suit-type cosmetic air massage device of this invention, the preceding suit-shaped parts are comprised of an upper suit-shaped part for an upper body and a lower suit-shaped part for a lower body, and plural air bags are installed within the upper suit-shaped part and the lower suit-shaped part and can connect solely or together with the preceding intake/exhaust instrument via each intaking/exhausting hose for providing compressed air from the preceding intake/exhaust instrument to the upper suit-shaped part and the lower suit-shaped part.

Further, in the suit-type cosmetic air massage device of this invention, the preceding plural air bags installed within the suit-shaped parts are divided into several groups, and air bags of the same group can be inflated/deflated simultaneously.

Further, in the suit-type cosmetic air massage device of this invention, the preceding plural air bags installed within the suit-shaped parts are divided into several groups, and left and right air bags of each group can be inflated/deflated simultaneously.

Further, in the suit-type cosmetic air massage device of this invention, the preceding intake/exhaust instrument has a control measure for repeating intaking/exhausting in order to preceding plural air bags installed within the preceding suit-shaped parts.

Further, in the suit-type cosmetic air massage device of this invention, the preceding control measure can intake the preceding plural air bags with air one by one, and exhaust them simultaneously after all of them have been inflated in order.

Further, in the suit-type cosmetic air massage device of this invention, the preceding control measure can intake all of air bags simultaneously, and exhaust them simultaneously after the inflated status of them has passed a set period of time.

Further, in the suit-type cosmetic air massage device of this invention, the preceding control measure has been equipped with an auto-timer program for stopping the intaking/exhausting after a set priod of time has passed from starting.

Further, in the suit-type cosmetic air massage device of this invention, a remote-control instrument is placed to an appropriate region of a hand of the preceding suit-shaped parts for starting/pausing/restarting of the preceding intake/exhaust instrument.

Further, in the suit-type cosmetic air massage device of this invention, several identically shaped connectors are equipped with junctions of preceding intaking/exhauting hoses and suit-shaped parts for separating from or connecting to those intaking/exhausting hoses.

Further, in the suit-type cosmetic air massage device of this invention, several T-shape sockets are equipped within each forked route of the preceding intaking/exhausting hoses.

With these constructions, a user can wear the suit-shaped parts to get air pressuring massage because the suit-shaped parts are equipped within plural inflatable/deflatable air bags covering almost the user's whole body.

Further, a user can only wear the upper suit-shaped part or the lower suit-shaped part to use because the suit is divided into an upper suit-shaped part for covering the upper part of a human body and a lower suit-shaped part for covering the lower part of a human body, and these upper and lower suit-part can be supplied or exhausted with air from the preceding intake/exhaust instrument. And also, the user can connect two suit-shaped parts with several identical and interchangeable connectors to use because each intaking/exhausting hose of preceding suit-shaped parts can be connected to or separated from each connector.

Further, the upper or lower part of a huamn body can be provided with synchronized air pressure by air bags of each group, by which plural air bags installed within the preceding suit-shaped parts are divided into several groups, and air bags of each group can be inflated/deflated simultaneously.

Further, the portions from both hands to both shoulders, and from feet to waist of a human body can be provided with same divided air pressuring massage, by which the preceding plural air bags are comprised of air bags of four groups, and the preceding four groups are comprised of sixteen air bags being arranged by four pairs of upper and lower air bags, and the upper four pairs are arranged by eight air bags symmetrically installed within left and right position from corresponding to both hands to corresponding to both shoulders of preceding upper suit-shaped part, as to be the first, second, third and fourth group, and the lower four pairs are arranged by eight air bags symmetrically installed within left and right position from corresponding to feet to corresponding to waist of the lower suit-shaped part, as to be the first, second, third and fourth group.

Further, a user's shoulders or waist can be provided with enforced pressure by which air bags of the preceding fourth group are overlapped to install (for example, one on top of another) within position corresponding to both shoulders and waist.

Further, it is possible to equip intaking/exhausting hoses without bending them, and easily equip them with an almost straight route of intaking/exhausting by this construction which T-shape sockets are equipped into each fork in the route of each intaking/exhausting hose, these hoses have forked routes connecting the intake/exhaust instrument with each of plural air bags divided into several groups, and air bags of same group can be inflated/deflated simultaneously.

Further, several new pressuring massage procedures can be provided by different intaking/exhausting in which a control measure is installed in the intake/exhaust instrument, and the control measure can operate intaking/exhausting of compressed air in several differing operational orders or time upon plural air bags divided into several groups for inflating/deflating simultaneously.

That is to say, the whole body of a human can be simultaneously provided with air pressuring massage by which programs are installed in the preceding control measure, and the programs can repeat the cycle intaking compressed air to preceding all of air bags divided into four groups simultaneously within a set period of time, and exhausting compressed air from air bags of all groups after a set period of time has passed.

Further, the position from both hands to both shoulders and the position from feet to waist can be provided with wave-type pressuring massage by inflated/exhausted of air bags of each group simultaneously in order, by which a program is installed in the preceding control measure for repeating the cycle of intaking/exhausting compressed air to/from air bags of preceding four groups, i.e. inflating to the first, second, third and fourth group in order for a set period of time.

Further, the position from both hands to both shoulders and the position from feet to waist can be provided with a squeeze-type air pressuring massage by cumulating pressure from air bags of each group simultaneously in order, by which a program is installed in the preceding control measure for repeating the successively cycle of intaking compressed air to air bags of preceding four groups, as to the first, second, third and fourth group in order for a set period of time, and simultaneously exhausting air bags of all groups after a set period of time.

Further, it is possible to prevent a user from fogetting to turn off a switch or using beyond an appointed time by which an auto-timer program installed in the preceding control measure can stop the intaking/exhausting after a set period of time has passed from starting.

Further, a user can start or pause or restart inflating/deflating of air bags of preceding each group while wearing the preceding suit-shaped parts by a hand operated the remote control instrument so that the user can pause the inflating/deflating of air bags immediately when the user feels too strong of a massage or uncomfortable, for which a remote control instrument is placed to the position corresponding to a hand region of the suit-shaped parts for operating the preceding intake/exhaust instrument to start or pause or restart the intaking/exhausting.

DETAILED DESCRIPTION

Figure 1:
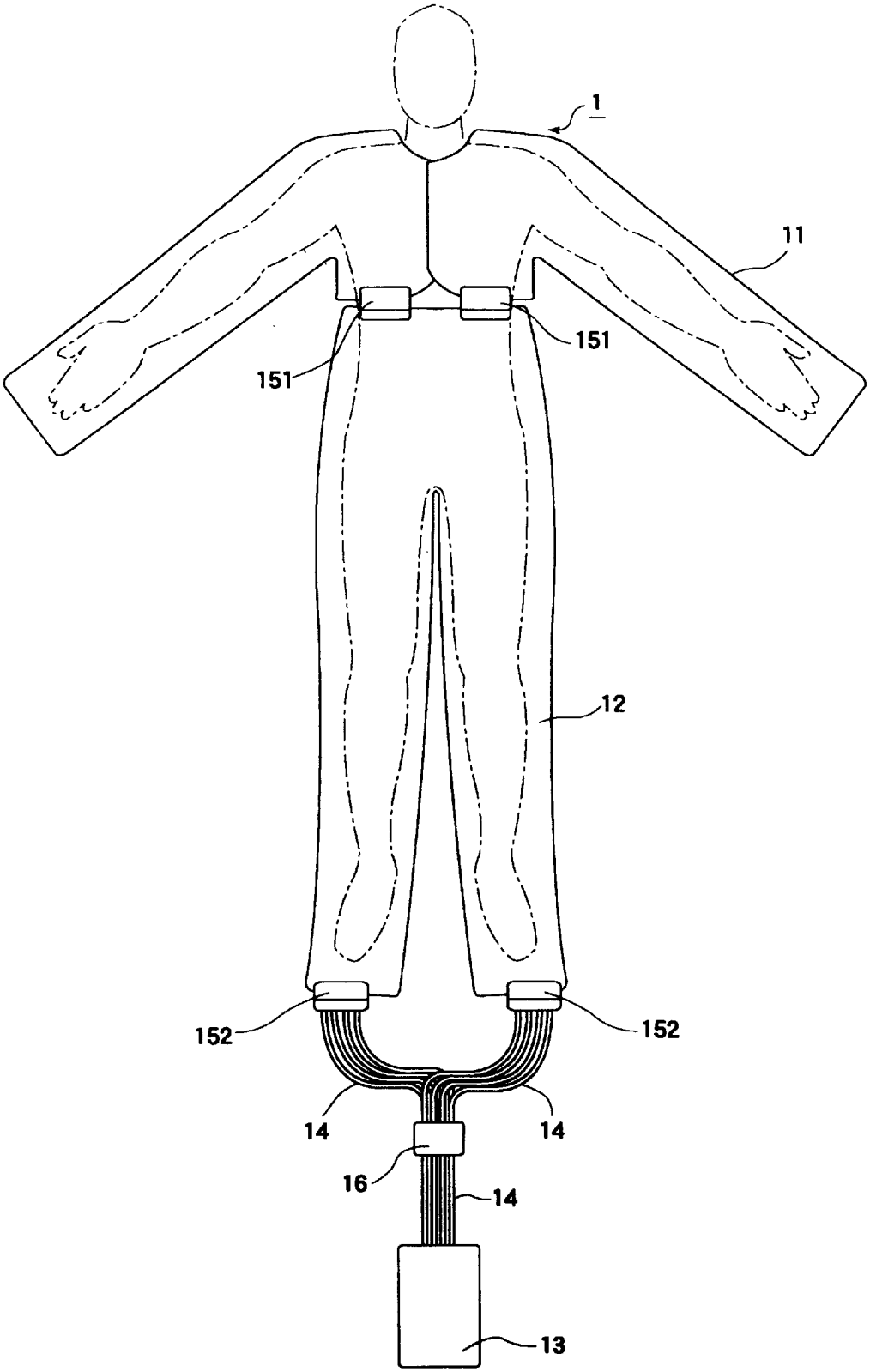
FIG. 1 depicts a front view of the suit-type cosmetic air massage device with a user in using status.
Figure 2:
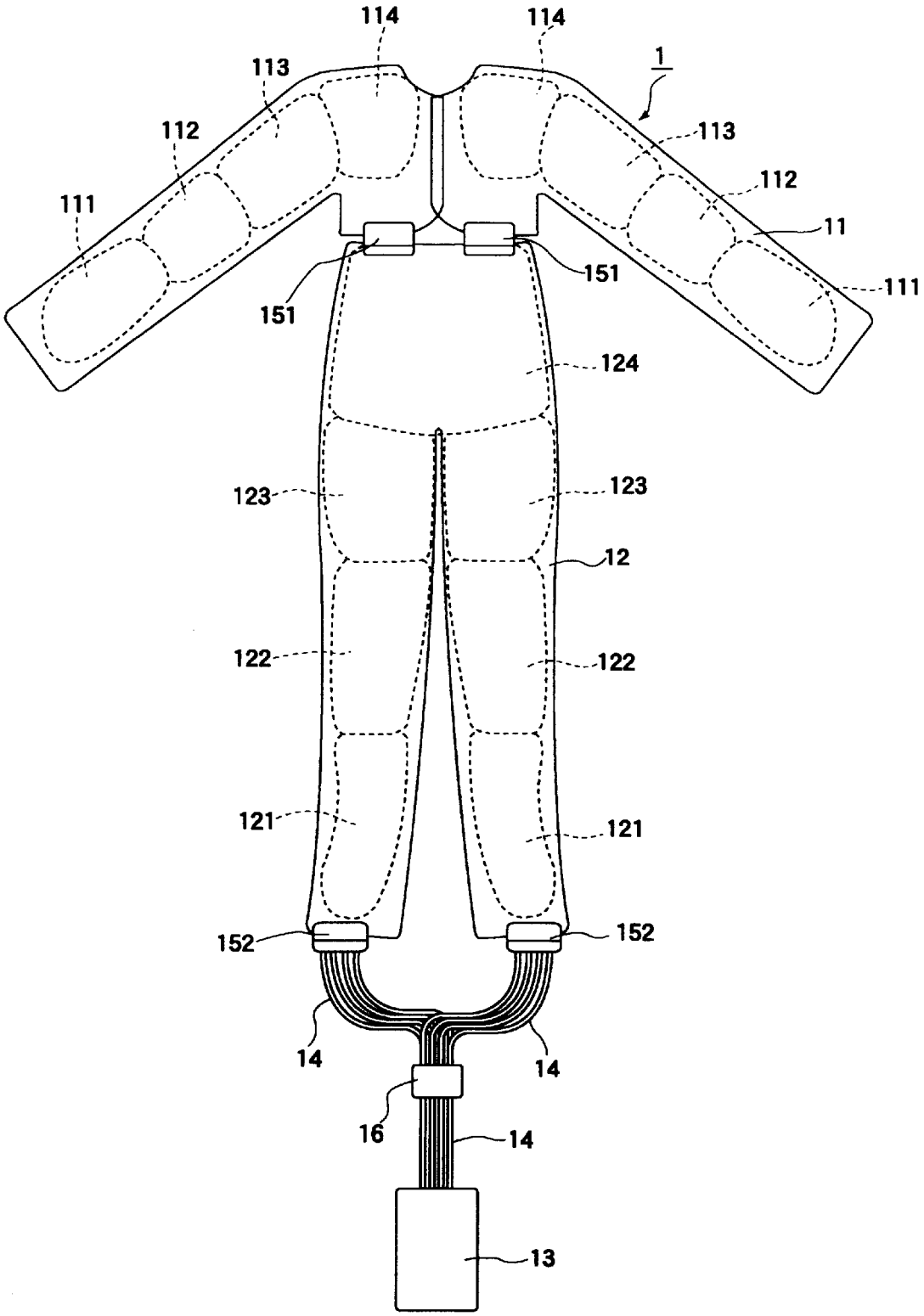
FIG. 2 depicts a front view of the suit-type cosmetic air massage device with an arrangement of plural air bags.
Figure 3:
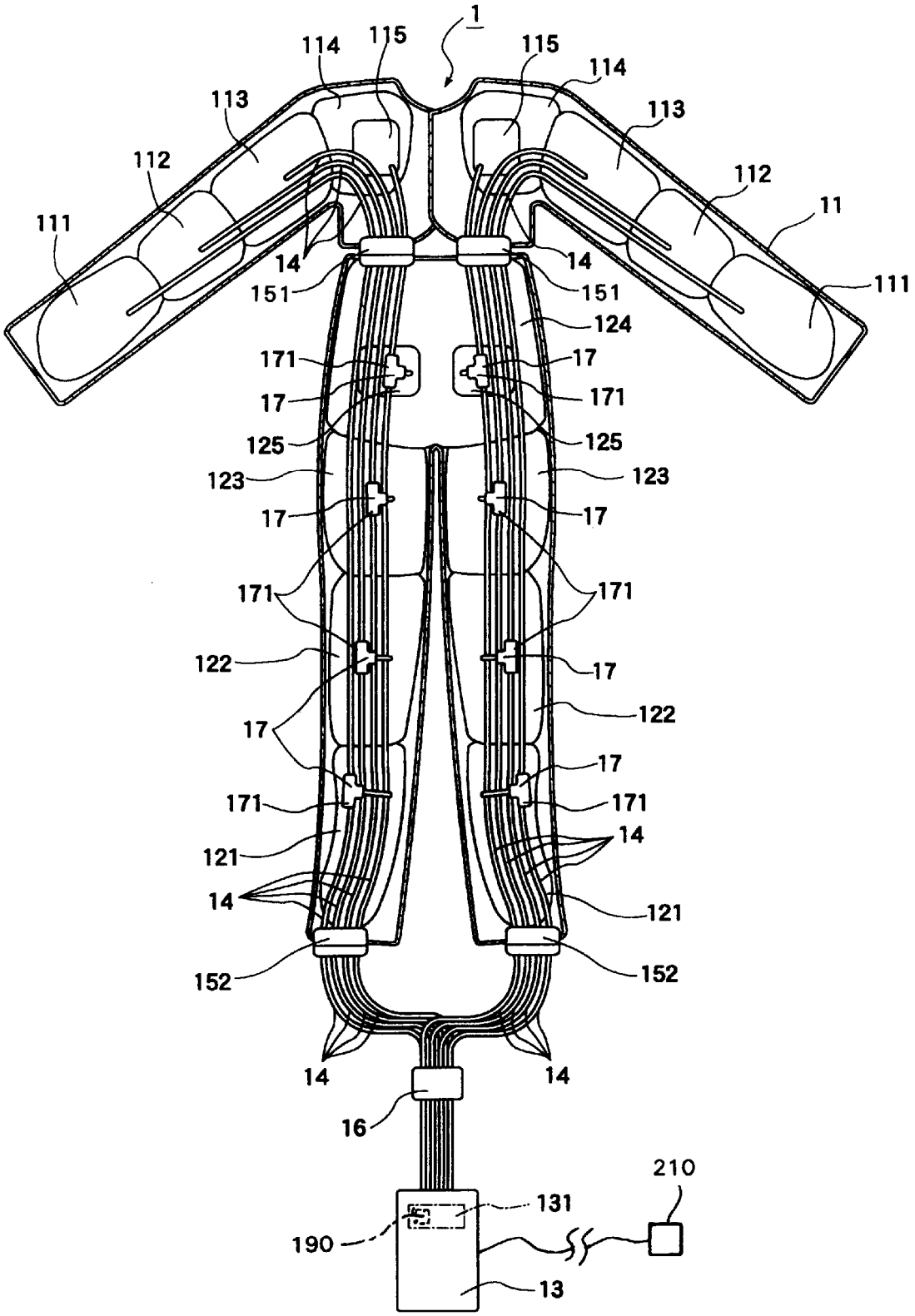
FIG. 3 depicts a front view of the suit-type cosmetic air massage device with all of parts.

As shown in FIGS. 1, 2, 3, the suit-type cosmetic air massage device 1 is comprised of an upper suit-shaped part 11 covering a user's upper body, a lower suit-shaped part 12 covering a user's lower body, plural air bags 111•112•113•114 being installed within each suit-shaped part 11, 12, an intake/exhaust instrument 13 being connected to the preceding plural air bags 111•112•113•114 and 121•122•123•124 via each intaking/exhausting hose 14, a control measure 131 being installed within the preceding intake/exhaust instrument 13 to control intaking/exhausting of compressed air to the preceding plural air bags 111•112•113•114 and 121•122•123•124, first connector 151 connecting the preceding suit-shaped part 11•12 with the preceding intaking/exhausting hose 14, and second connector 152 connecting the lower suit-shaped part 12 to the preceding intaking/exhausting hose 14. As shown in the drawing figures, there are two connectors 151 having the same shape and two connectors 152 having the same shape.

The preceding upper suit-shaped part 11 is made from an elastic material, such as synthetic fiber, and is shaped into an upper suit to cover a user's upper body as shown in FIG. 2.

Air bags 111 of the first group, air bags 112 of the second group, air bags 113 of the third group, and air bags 114 of the fourth group using for an upper body of a human are symmetrically installed within left and right positions corresponding to from both hands to both shoulders of the preceding upper suit-shaped part 11 as shown in FIG. 3.

Further, each of eight air bags of four pairs of air bags 111 of first group, air bags 112 of second group, air bags 113 of third group, air bags 114 of fourth group are respectively connected with a pair of the preceding first connectors 151 disposed symmetrically on the left and right bottom of the preceding upper suit-shaped part 11 by preceding intaking/exhausting 14. The first connectors 151 are identically shaped.

Further, the preceding air bags 114 of fourth group can be comprised of two layers by overlapping a secondary shoulder air bags 115, as shown in FIG. 3. The overlapped two layers of air bags in air bags 114. enforce pressure upon a user's shoulders.

Figure 4:
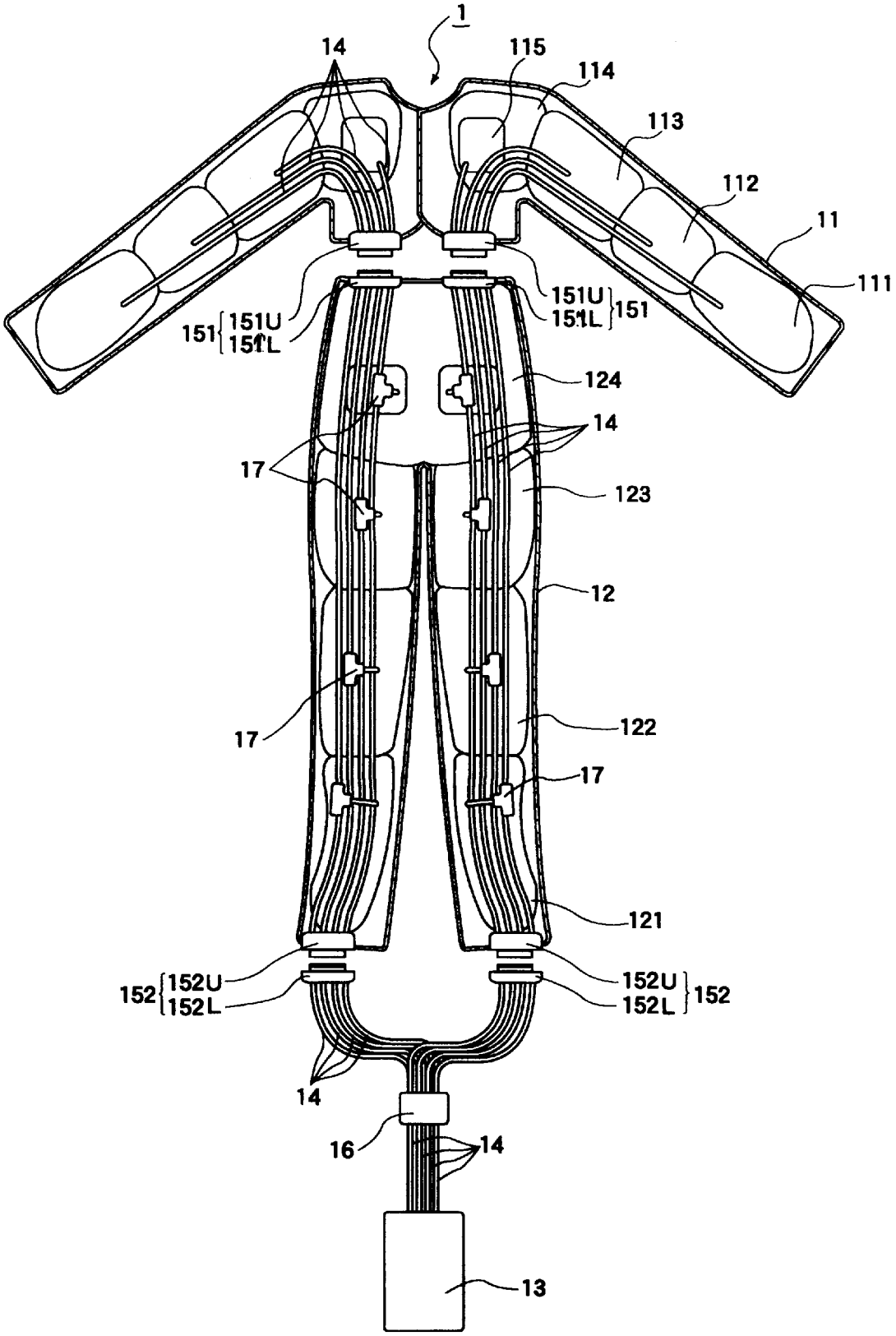
FIG. 4 depicts a front view of the suit-type cosmetic air massage device with separated to three parts.

The preceding first connectors 151 are made from hard material, such as synthetic resin, and are disposed symmetrically on left and right border between the preceding upper suit-shaped part 11 and the lower suit-shaped part 12 as shown in FIG. 4, for connecting each of intaking/exhausting hoses with the preceding each air bags 111 and 121, 112 and 122 , 113 and 123, 114 and 124 of the four groups.

Further, each first connector 151 is comprised of a pair of upper members 151U respectively on left and right of the upper suit-shaped part 11, and a pair of lower members 151L on left and right of the upper area of the lower suit-shaped part 12 as shown in FIG. 4. The upper members 151U and the lower members 151L can easily be separated/connected by operating hooks (not shown).

And also, the preceding lower suit-shaped part 12 is made from an elastic material, such as synthetic fiber, as the same to the preceding upper suit-shaped part 11, and is shaped into a lower suit for covering a user's lower body as shown in FIG. 2 and FIG. 3.

Air bags 121 of the first group, air bags 122 of the second group, air bags 123 of the third group, and air bags 124 of the fourth group using for a lower body of a human are symmetrically installed within left and right positions corresponding to from feet to waist of the preceding lower suit-shaped part 12 as shown in FIG. 3.

Further, each of eight air bags of four pairs of air bags 121 of first group, air bags 122 of second group, air bags 123 of third group, air bags 124 of fourth group are respectively connected with each intaking/exhausting hose 14 having several forked routers 171 installed within among a pair of the preceding first connectors 151 disposed symmetrically on the left and right upper of the preceding lower suit-shaped part 12 and second connectors 152 disposed symmetrically on the left and right bottom of the preceding lower suit-shaped part 12.

Further, a T-shape socket 17 is installed within the preceding forked router 171 as shown in FIG. 3.

Further, the preceding air bags 124 of fourth group can be comprised of two layers by overlapping a secondary waist air bag 125, as shown in FIG. 3. The overlapped air bags in the fourth group enforce pressure upon a user's waist.

The preceding second connector 152 is made from hard material, such as synthetic resin, same as the first connector 151, and is disposed symmetrically on left and right of bottom of the preceding lower suit-shaped part 12 to relay and compile each intaking/exhausting hose 14 to a mutual connector 16 as shown in FIG. 4. The pair of second connectors 152 at the bottom of lower suit-shaped part 12 are identical.

Further, the second connectors 152 is comprised of a pair of upper members 152U respectively on left and right of the lower area of the lower suit-shaped part 12, and a pair of lower members 152L respectively on left and right of the air hose groupings 14 as shown in FIG. 4. The upper members 152U and the lower members 152L can be easily separated/connected by operating hooks (not shown).

Therefore, when all of the preceding first connectors 151 and the second connectors 152 are separated, the suit-type cosmetic air massage device can be divided into three parts, i.e. the part of the upper suit-shaped part 11, a part of the lower suit-shaped part 12, and a part of the intake/exhaust instrument 13 as shown in FIG. 4.

Figure 5:
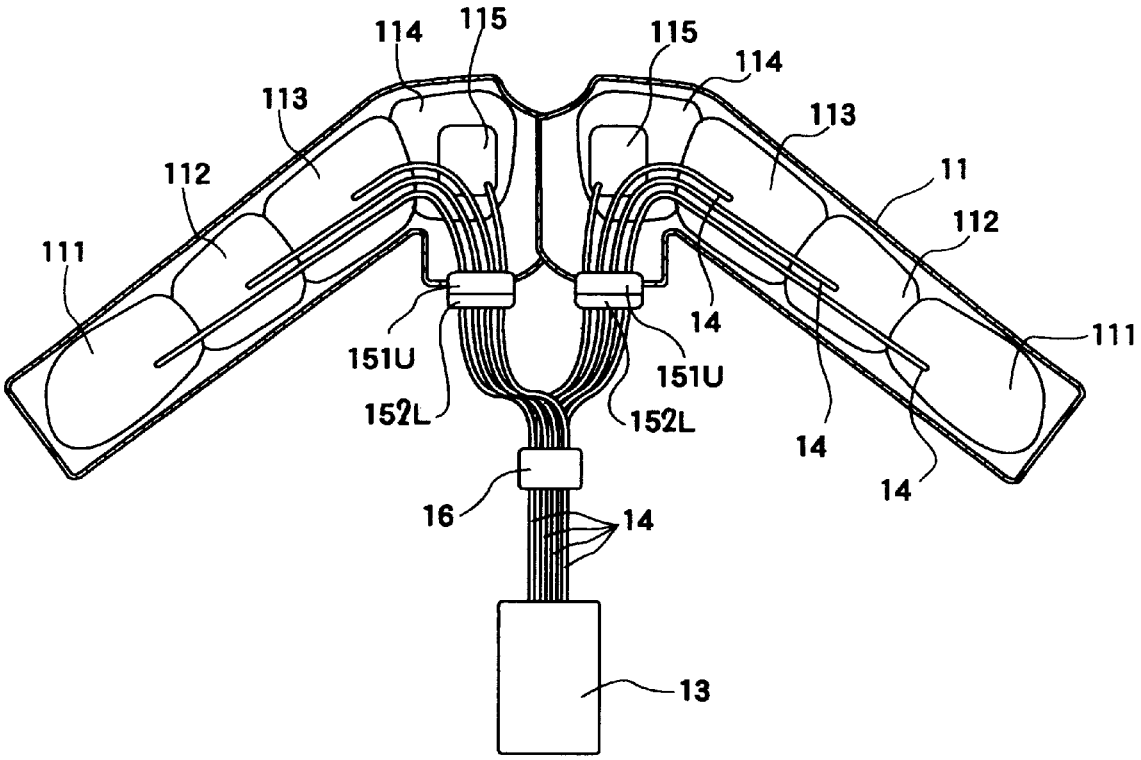
FIG. 5 depicts a front view of the suit-type cosmetic air massage device with only upper suit-shaped part.

Subsequently, as shown in FIG. 5, a user can use only the upper suit-shaped part 11 because the first connector 151 and the shape connector 152 are made from same material and members, the upper member 151U of the first connector 151 and the lower member 152L of the second connector 152 are easily connnected together by operating the hooks as done with joining members 152U, 152L or members 151U, 151L.

Figure 6:
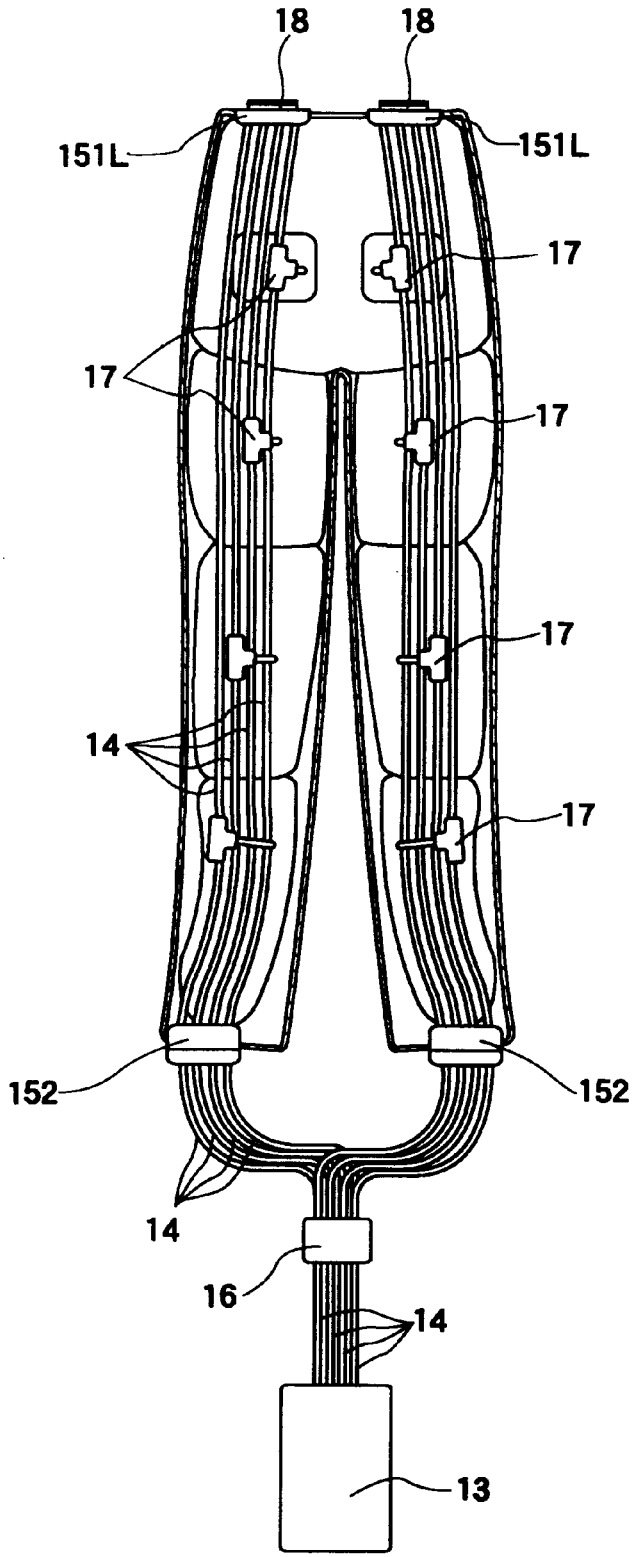
FIG. 6 depicts a front view of the suit-type cosmetic air massage device with only lower suit-shaped part.
Figure 8:
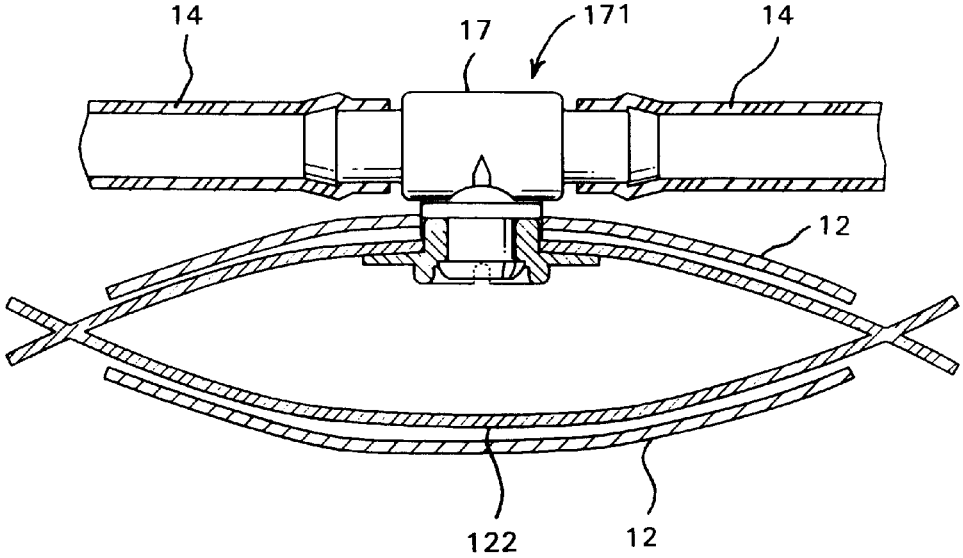
FIG. 8 depicts the T-shaped socket at the forked air hose routes.

Further, as shown in FIG. 6, a user can use only the lower suit-shaped part 12, because the upper member 151U and lower member 151L of the first connectors 151 can be separated, and their lower member 151L can be inserted by a stopper 18 for preventing air from exhausting while the second connectors 152 are in the connected status.

Further, as shown in FIGS. 3, 16 is a mutual connector and is equipped for compiling a pair of left and right intaking/exhausting hoses 14 connecting the same air bags of same groups (for example, a pair of air bags of first groups using for upper body) of a pair of air bags 111 to 114 of first group to fourth group installed within left and right of the preceding upper suit-shaped part 11 used for massaging the upper body, and a pair of air bags 121 to 124 of first group to fourth group installed within left and right of the preceding lower suit-shaped part 12 used for massaging the lower body, so that a pair of left and right intaking/exhausting hoses 14 are compiled to one route, and four pairs of them can become to four routes to connect with the intake/exhaust instrument 13 through the preceding mutual connector 16.

That is to say, the air bags 111 of first group used for the upper body and air bags 121 of first group used for the lower body, the air bags 112 of first group used for the upper body and air bags 122 of first group used for the lower body, and air bags 113 of first group used for the upper body and air bags 12 3 of first group used for lower body, and air bags 114 of first group used for the upper body and air bags 124 of first group using for the lower body can be connected with the intake/exhaust instrument 13 through each same intaking/exhausting hose.

The preceding intake/exhaust instrument 13 is installed within a supplying device 200 of compressed air, such as an air compressor, and connected respectively with each air bags of each one of four groups via the above-mentioned four intaking/exhausting routes.

And four electromagnetic valves for intaking and four electromagnetic valves for exhausting (not shown) are equipped near the preceding intake/exhaust instrument 13 and are controlled to open or close respectively by the control measure 131 as shown in FIG. 3 to intake/exhaust independently upon preceding four intaking/exhausting routes.

Further the preceding control measure 131, for example, can be equipped with a program which can control all of the preceding four electromagnetic valves for opening to intake simultaneously after a set period of time and subsequently to open all of the preceding four electromagnetic valves for exhausting, and repeat this cycle, or a program which can control the four electromagnetic valves for intaking and four electromagnetic valves for exhausting to change the opening or closing of each other in order and in a set time period, and repeat this cycle.

Therefore, the preceding intake/exhaust instrument 13 can inflate/deflate the preceding air bags 111•121 of the first group, 112•122 of the second group, 113/123 of the third group, and 114/124 of the fourth group simultaneously in order by operating the preceding a program equipped in the preceding control measure 131. The control measure 131 may have an auto-timer program 190 stored therein for automatically ending the massage after a set time period (FIG. 3).

Figure 7:
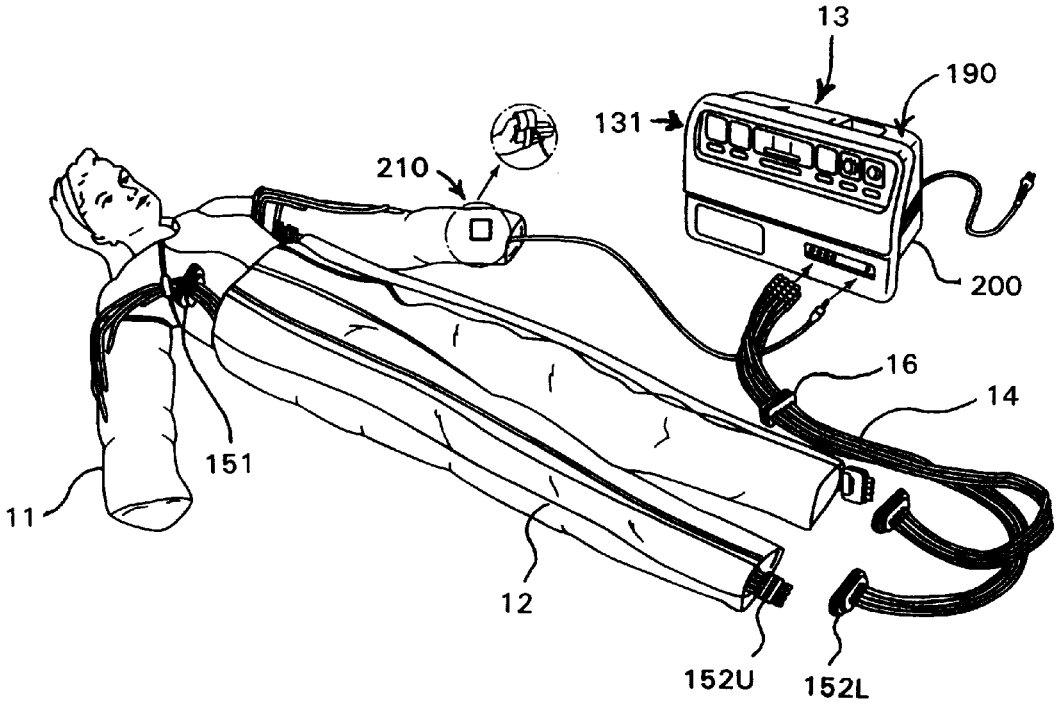
FIG. 7 depicts the suit in use with the air hose disconnected from the lower part of the suit and controller for clarity of illustration.

Further, referring to FIG. 7, the control measure 131 may be equipped with a remote control instrument 210 for starting/pausing/restarting the inflating/deflating of the preceding air bags of each group, and the control unit 131 is linked to and operated by a remote controller 210 which may be placed to an appropriate position corresponding to a hand region of the preceding upper suit-shaped part 11.

Consequently, the present invention can provide a new pressure feel that is different from conventional air massage devices, and effective cosmetic air massage upon a user's whole body, and also, can provide with balanced cosmetic air massage upon almost a user's whole body or only upper body or only lower body.

Further, the present invention can provide simultaneously with wave-type air massage and squeezed-type air massage upon regions from both hands to shoulders and from feet to waist, that is to say , from bottom of lower body to center of the human upper body, and can provide new pressure feel of air pressuring massage simultaneously upon almost whole body, not provided before, so that circulations of body liquid, such as blood, can be improved, and muscular stiffness can be softened etc.

What is claimed is:

1. A suit-type cosmetic air massage device comprising:

upper and lower suit-shaped parts respectively receiving upper and lower parts of a person therein;

a plurality of inflatable/deflatable air bags installed within each of the upper and lower suit-shaped parts;

a plurality of air intake/exhaust hoses, each of said plurality of hoses being connected to at least one of said plurality of air bags, each said hose having a first part extending on said upper suit-shaped part, a second part extending through said lower suit-shaped part, and a third part extending from said lower suit-shaped part;

an intake/exhaust instrument connected to said third part of said hoses for supplying air to said plurality of the air bags; and a remote control instrument positioned in a hand receiving region of said upper suit-shaped part, said remote control instrument having means for operating said intake/exhaust instrument so as to start/pause/restart said intake/exhaust instrument.

2. The suit-type cosmetic air massage device according to claim 1, wherein each said hose is connected to one said air bag in said lower suit-shaped part and to one said air bag in said upper suit-shaped part, whereby both said air bags connected to each said hose simultaneously inflate with air supplied by said intake/exhaust instrument.

3. The suit-type cosmetic air massage device according to claim 2, further comprising: said plurality of air bags being divided into several groups, and means for simultaneously inflating said air bags in one of said groups.

4. The suit-type cosmetic air massage device according to claim 3, further comprising: each said group of said air bags having at least one said air bag on a left side of said upper and lower suit-shaped parts and at least one said air bag on a right side of said upper and lower suit-shaped parts, and means for simultaneously inflating said left air bag and right air bag in one said group.

5. The suit-type cosmetic air massage device according to claim 4, further comprising: a control means disposed on said intake/exhaust instrument for repeatedly sequentially inflating and exhausting said air bags in said upper and lower suit-shaped parts.

6. The suit-type cosmetic air massage device according to claim 5, wherein said control means has means for maintaining said air bags in an inflated state, and means for simultaneously exhausting all air bags at a time after all of air bags have been inflated.

7. The suit-type cosmetic air massage device according to claim 4, wherein a control means is disposed on said intake/exhaust instrument for simultaneously inflating all of air bags and simultaneously deflating all of the inflated air bags after a set period of time has passed.

8. The suit-type cosmetic air massage device according to claim 5, wherein said control means has an auto-timer means for operating said intake/exhaust instrument to stop intaking/exhausting after a set period of time has passed from starting.

9. A suit-type cosmetic air massage device according to claim 1, further comprising:

first releasable connectors joining said first and second hose parts, and second releasable connectors joining said second and third hose parts.

10. The suit-type cosmetic air massage device according to claim 9, further comprising:

T-shape sockets installed in said second hose parts, said T-shape sockets providing a through flow path in each said hose and respectively providing a supply path from each said hose to one said air bag on said lower suit part.

11. The suit-type cosmetic air massage device according to claim 10, wherein each said hose is connected to one said air bag in said lower suit-shaped part and to one said air bag in said upper suit-shaped part, whereby both said air bags connected to each said hose simultaneously inflate with air supplied by said intake/exhaust instrument.

12. A suit-type air massage device, comprising an upper suit part for receiving an upper body portion of a user therein, a lower suit part for receiving a lower body portion of a user therein, a first plurality of air bags positioned in said upper suit part for massaging the upper body portion, a second plurality of air bags positioned in said lower suit part for massaging the lower body portion, a plurality of elongate first hoses positioned in said upper suit part, each said first hose having a first end connected to a respective one of said first air bags, a plurality of elongate second hoses positioned in said lower suit part, each said second hose having third and fourth ends, said second plurality of said air bags being respectively connected to said second hoses intermediate said third and fourth ends thereof, a plurality of elongate third hoses each having fifth and sixth ends, a first connector part having second ends of said first hoses connected thereto and positioned at a junction between said upper and lower suit parts, a second connector part having said third ends of said second hoses connected thereto, said second connector part being releasably connectable to said first connector part;

a third connector part having said fourth ends of said second hoses connected thereto and positioned at a foot end of said lower suit part remote from said upper suit part, a fourth connector part having said fifth ends of said third hoses connected thereto, said fourth connector part being releasably connectable to said third connector part;

an air supply device connected to said sixth ends of said third hoses for supplying pressurized air to said first and second air bags; and a remote control instrument positioned in a hand receiving region of said upper suit part, said remote control instrument having means for operating said air supply device so as to start/pause/restart said air supply device.

* * * * *